US008857355B2

(12) United States Patent
Nomura et al.

(10) Patent No.: US 8,857,355 B2
(45) Date of Patent: Oct. 14, 2014

(54) SEWING MACHINE AND NON-TRANSITORY COMPUTER READABLE STORAGE MEDIUM STORING PROGRAM

(71) Applicants: Yutaka Nomura, Anjo (JP); Satoru Makino, Nagoya (JP); Yuki Ihira, Kakamigahara (JP); Daisuke Abe, Nagoya (JP); Yoshio Nishimura, Nagoya (JP); Yoshinori Nakamura, Toyohashi (JP); Satoru Ichiyanagi, Nagoya (JP)

(72) Inventors: Yutaka Nomura, Anjo (JP); Satoru Makino, Nagoya (JP); Yuki Ihira, Kakamigahara (JP); Daisuke Abe, Nagoya (JP); Yoshio Nishimura, Nagoya (JP); Yoshinori Nakamura, Toyohashi (JP); Satoru Ichiyanagi, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 13/788,979

(22) Filed: Mar. 7, 2013

(65) Prior Publication Data

US 2013/0233220 A1 Sep. 12, 2013

(30) Foreign Application Priority Data

Mar. 12, 2012 (JP) ..... 2012-055106

(51) Int. Cl.

| | |
|---|---|
| ***D05B 21/00*** | (2006.01) |
| ***D05B 19/12*** | (2006.01) |
| ***D05B 51/00*** | (2006.01) |
| *D05C 5/00* | (2006.01) |

(52) U.S. Cl.

CPC ..... *D05B 19/12* (2013.01); *D05B 51/00* (2013.01)

USPC ..... 112/470.06; 700/137

(58) Field of Classification Search

USPC ..... 112/470.01–470.18, 102, 5, 103, 220, 112/260; 700/136–138

See application file for complete search history.

(56) References Cited

U.S. PATENT DOCUMENTS

| | | | | |
|---|---|---|---|---|
| 3,966,331 | A * | 6/1976 | Inuiya | 356/391 |
| 4,712,497 | A | 12/1987 | Nomura et al. | |
| 4,998,489 | A * | 3/1991 | Hisatake et al. | 112/103 |

(Continued)

FOREIGN PATENT DOCUMENTS

| | | |
|---|---|---|
| JP | A-61-247495 | 11/1986 |
| JP | S64-040386 | 3/1989 |

(Continued)

OTHER PUBLICATIONS

U.S. Appl. No. 13/788,903, filed Mar. 7, 2013 in the name of Yoshio Nishimura et al.

(Continued)

*Primary Examiner* — Ismael Izaguirre
(74) *Attorney, Agent, or Firm* — Oliff PLC

(57) ABSTRACT

A sewing machine that includes a sewing device that includes a needle bar configured to attach a sewing needle, and a transport device configured to move a work cloth, a processor, a plurality of detection devices that are configured to detect ultrasonic waves, and a memory that is configured to store computer-readable instructions that instruct the sewing machine to execute steps comprising specifying, when an ultrasonic wave transmitted from a transmission source of the ultrasonic wave is detected by the detection devices, a position of the transmission source of the ultrasonic waves, based on the detected ultrasonic waves, specifying a sewing position on the work cloth based on the specified position of the transmission source, and moving the work cloth by the transport device in accordance with the specified sewing position.

12 Claims, 16 Drawing Sheets

(56) References Cited

U.S. PATENT DOCUMENTS

| | | | | |
|---|---|---|---|---|
| 6,000,350 | A * | 12/1999 | Koike et al. | 112/102.5 |
| 6,883,446 | B2 | 4/2005 | Koerner | |
| 7,079,917 | B2 * | 7/2006 | Taguchi et al. | 700/138 |
| 7,373,891 | B2 * | 5/2008 | Koerner | 112/475.02 |
| 8,061,286 | B2 | 11/2011 | Hirata et al. | |
| 8,074,590 | B2 | 12/2011 | Bentley | |
| 8,528,491 | B2 * | 9/2013 | Bentley | 112/470.04 |
| 8,567,329 | B2 | 10/2013 | Kishi | |
| 8,763,542 | B2 | 7/2014 | Abe et al. | |
| 2004/0182295 | A1 * | 9/2004 | Pfeifer | 112/119 |
| 2009/0188413 | A1 | 7/2009 | Hirata et al. | |
| 2012/0111249 | A1 * | 5/2012 | Sekine | 112/102.5 |
| 2012/0210925 | A1 * | 8/2012 | Koga et al. | 112/470.04 |
| 2013/0233217 | A1 * | 9/2013 | Shimizu et al. | 112/102.5 |
| 2013/0233220 | A1 | 9/2013 | Nomura et al. | |
| 2013/0233221 | A1 | 9/2013 | Abe et al. | |
| 2013/0233222 | A1 | 9/2013 | Nishimura et al. | |
| 2013/2332190 | | 9/2013 | Nakamura et al. | |
| 2014/0000498 | A1 | 1/2014 | Yamanashi et al. | |

FOREIGN PATENT DOCUMENTS

| | | |
|---|---|---|
| JP | A-06-000264 | 1/1994 |
| JP | A-2007-128120 | 5/2007 |
| JP | A-2009-172123 | 8/2009 |

OTHER PUBLICATIONS

U.S. Appl. No. 13/788,928, filed Mar. 7, 2013 in the name of Yoshinori Nakamura et al.
U.S. Appl. No. 13/789,046, filed Mar. 7, 2013 in the name of Daisuke Abe et al.
U.S. Appl. No. 13/789,061, filed Mar. 7, 2013 in the name of Yoshio Nishimura et al.
U.S. Appl. No. 13/788,893, filed Mar. 7, 2013 in the name of Akie Shimizu et al.
Feb. 4, 2014 Office Action issued in Japanese Patent Application No. 2012-055103 (with English Translation).
U.S. Appl. No. 14/054,161, filed Oct. 15, 2013 in the name of Ryutaro Maki.
Jul. 30, 2014 Office Action issued in U.S. Appl. No. 13/788,903.

* cited by examiner

SEWING MACHINE AND NON-TRANSITORY COMPUTER READABLE STORAGE MEDIUM STORING PROGRAM

CROSS-REFERENCE TO RELATED APPLICATION

This Application claims priority to Japanese Patent Application No. 2012-055106, filed on Mar. 12, 2012, the content of which is hereby incorporated by reference.

BACKGROUND

The present disclosure relates to a sewing machine and a non-transitory computer-readable storage medium storing a program that are capable of performing sewing in a specified position on a work cloth.

Conventionally, a sewing machine is known that can easily set a sewing position and a sewing angle on a work cloth when sewing a desired embroidery pattern. For example, a sewing machine is disclosed that is provided with an imaging device that captures an image of a marker adhered in a specified position on the work cloth, and that automatically sets the sewing position and the sewing angle of the embroidery pattern based on an image of the marker that is captured.

SUMMARY

However, in the above-described sewing machine, it is necessary to adhere the marker to the work cloth. Further, after the sewing machine sets the sewing position and the sewing angle of the embroidery pattern, it is necessary to remove the marker that is adhered to the work cloth before performing the sewing, thus making operations troublesome.

It is an object of the present disclosure to provide a sewing machine and a non-transitory computer-readable storage medium storing a program that allow a user to easily set a position on a work cloth on which sewing is to be performed.

A sewing machine according to a first aspect of the present disclosure includes a sewing device, a plurality of detection devices, a processor, and a memory. The sewing device includes a needle bar that is configured to have a sewing needle, and a transport device that is configured to move a work cloth. The plurality of detection devices is configured to detect an ultrasonic wave. The memory is configured to store computer-readable instructions that instruct the sewing machine to execute steps including specifying, when an ultrasonic wave transmitted from a transmission source of the ultrasonic wave is detected by the detection devices, a position of the transmission source of the ultrasonic waves, based on the detected ultrasonic waves, specifying a sewing position on the work cloth based on the specified position of the transmission source, and moving the work cloth by the transport device in accordance with the specified sewing position.

A non-transitory computer-readable medium according to a second aspect of the present disclosure stores computer-readable instructions that instruct a sewing machine. The sewing machine includes a sewing device and a plurality of detection devices. The sewing device includes a needle bar configured to attach a sewing needle, and a transport device configured to move a work cloth. The plurality of detection devices is configured to detect an ultrasonic wave. The computer-readable instructions instruct the sewing machine to execute steps including specifying, when an ultrasonic wave transmitted from a transmission source of the ultrasonic wave is detected by the detection devices, a position of the transmission source of the ultrasonic waves, based on the detected ultrasonic waves, specifying a sewing position on the work cloth based on the specified position of the transmission source, and moving the work cloth by the transport device in accordance with the specified sewing position.

BRIEF DESCRIPTION OF THE DRAWINGS

Embodiments will be described below in detail with reference to the accompanying drawings in which.

DETAILED DESCRIPTION OF THE EXEMPLARY EMBODIMENTS

First Embodiment

Figure 1:
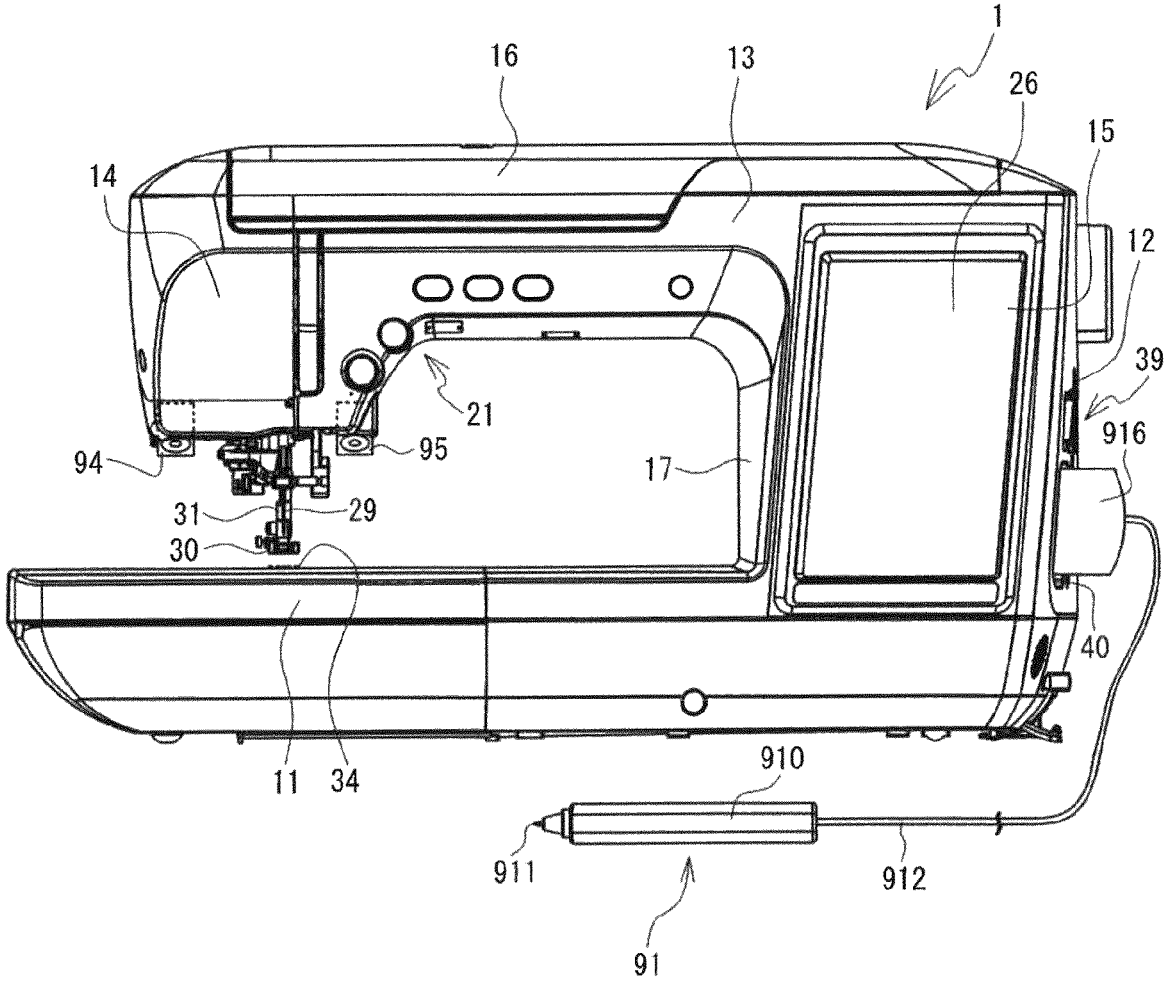
FIG. 1 is a front view of a sewing machine 1 according to a first embodiment.

Hereinafter, a first embodiment that gives material form to the present disclosure will be explained with reference to the drawings. Note that the drawings are used for explaining technological features that the present disclosure can utilize, and are intended in no way to limit the present disclosure. The configuration of a sewing machine 1 will be explained with reference to FIG. 1. The front side, the rear side, the top side, the bottom side, the left side, and the right side in FIG. 1 respectively correspond to the front side, the rear side, the top side, the bottom side, the left side, and the right side of the sewing machine 1.

The sewing machine 1 is provided with a bed 11, a pillar 12, an arm 13, and a head 14. The bed 11 is a base portion of the sewing machine 1, and it extends in the left-right direction. The pillar 12 extends upward from the right end of the bed 11. The arm 13 extends to the left from the upper end of the pillar 12 such that it is opposite the bed 11. The head 14 is located on the left end of the arm 13. A needle plate 34 is disposed on the top face of the bed 11. A feed dog (not shown in the drawings), a feed mechanism (not shown in the drawings), a shuttle mechanism (not shown in the drawings), and a feed adjustment motor 83 (refer to FIG. 5) are provided underneath the needle plate 34 (that is, inside the bed 11). The feed dog is driven by the feed mechanism and moves a work cloth 100 (refer to FIG. 6) by a specified feed amount. The feed amount for the feed dog is adjusted by the feed adjustment motor 83.

A needle bar 29 and a presser bar 31 extend downward from the lower end of the head 14. A sewing needle (not shown in the drawings) is replaceably mounted on the lower end of the needle bar 29. A presser foot 30 is replaceably mounted on the lower end of the presser bar 31. The presser foot 30 presses on the work cloth 100. A needle bar drive mechanism (not shown in the drawings), a swinging-and-releasing motor 80 (refer to FIG. 5), and the like are provided in the head 14. The needle bar drive mechanism drives the needle bar 29 up and down. The needle bar drive mechanism is driven by a drive shaft (not shown in the drawings) that is rotated by a sewing machine motor 79 (refer to FIG. 5). A needle bar release mechanism is a known mechanism, and it is provided inside the needle bar drive mechanism. The needle bar release mechanism switches between a connected state in which the needle bar drive mechanism and the needle bar 29 are connected and a released state in which the needle bar drive mechanism and the needle bar 29 are released. In the connected state, a driving force is transmitted from the needle bar drive mechanism to the needle bar 29. In the released state, the driving force from the needle bar drive mechanism to the needle bar 29 is cut off. In other words, the needle bar release mechanism switches between a mode in which the needle bar 29 is driven up and down and a mode in which the needle bar 29 is stopped. In a case where the needle bar release mechanism stops the needle bar 29, the needle bar 29 is moved to highest position in the up-down direction and is held in the highest position. The needle bar release mechanism is driven by the swinging-and-releasing motor 80.

A receiver 94 is provided on the rear part of the bottom face of the head 14 at the lower left edge of the head 14. A receiver 95 is provided on the rear part of the bottom face of the head 14 at the lower right edge of the head 14. The receivers 94, 95 are separated from one another by the length of the head 14 in the left-right direction. The receivers 94, 95 receive (detect) ultrasonic waves. The receivers 94, 95 will be described in detail later.

A cover 16 that can be opened and closed is provided in the upper portion of the arm 13. A spool (not shown in the drawings) is accommodated under the cover 16, that is, approximately in the central portion inside the arm 13. An upper thread (not shown in the drawings) that is wound around the spool is supplied from the spool to the sewing needle that is mounted on the needle bar 29, by way of a thread guard (not shown in the drawings) that is provided in the head 14. A plurality of operation switches 21 that include a start-and-stop switch are provided in the lower portion of the front face of the arm 13.

An LCD (liquid crystal display) 15 is provided on the front face of the pillar 12. A screen that includes various types of items, such as commands, illustrations, setting values, messages, and the like, is displayed on the LCD 15. A touch panel 26 is provided on the front face of the LCD 15. If a user performs a pressing operation on the touch panel 26 by using a finger or a special touch pen, the item that corresponds to the position where the pressing was detected by the touch panel 26 is recognized as having been selected. Hereinafter, the pressing operation is referred to as a "panel operation." In response to the panel operation that is described above, the sewing machine 1 accepts a pattern to be sewn or a command to be executed that is selected by the user.

Connectors 39, 40 are provided on the right side face of the pillar 12. An external storage device (not shown in the drawings) such as a memory card or the like can be connected to the connector 39. The sewing machine 1 acquires embroidery pattern data and various types of programs from the external storage device that is connected to the connector 39. A connector 916 is connected to the connector 40. The connector 916 is connected to a cable 912 that extends from an ultrasonic pen 91 (described later). The sewing machine 1 supplies electric power to the ultrasonic pen 91 through the connector 40, the connector 916, and the cable 912, and it also acquires electrical signals that are output from the ultrasonic pen 91.

The ultrasonic pen 91 will be explained. The ultrasonic pen 91 is provided with a pen body 910 and a pen tip 911. The shape of the pen body 910 is a bar shape. The pen tip 911 is provided on one end of the pen body 910. The tip of the pen tip 911 is pointed. Ordinarily, the pen tip 911 is in a projecting position in which the pen tip 911 projects slightly to the outside of the pen body 910. However, when a force acts on the 911 in the direction toward the pen body 910, the pen tip 911 moves into the pen body 910. When the force that is acting on the pen tip 911 ceases, the pen tip 911 returns to the original projecting position.

A switch 913 (refer to FIG. 5), a signal output circuit 914 (refer to FIG. 5), and an ultrasonic transmitter 915 (refer to FIG. 5) are provided inside the pen body 910. The switch 913 switches output states of the signal output circuit 914 and the ultrasonic transmitter 915 in accordance with the position of the pen tip 911.

When the user presses the pen tip 911 against a desired position on the work cloth 100, a force acts on the pen tip 911. When the force acts on the pen tip 911, the pen tip 911 moves into the pen body 910, and the switch 913 operates the signal output circuit 914 and the ultrasonic transmitter 915. Then the signal output circuit 914 outputs an electrical signal to the sewing machine 1 through the cable 912, and the ultrasonic transmitter 915 transmits ultrasonic waves. In contrast, when a force is not acting on the pen tip 911 (when the pen tip 911 is in the projecting position), the switch 913 does not operate the signal output circuit 914 and the ultrasonic transmitter 915. Therefore, the signal output circuit 914 does not output the electrical signal, and the ultrasonic transmitter 915 does not transmit the ultrasonic waves.

Note that the sewing machine 1 uses the receivers 94, 95 to detect (receive) the ultrasonic waves that are transmitted from the ultrasonic pen 91, although this will be described in detail later. Based on the times when the ultrasonic waves were detected by the receivers 94, 95, the sewing machine 1 specifies the position of the transmission source of the ultrasonic waves, that is, the position of the ultrasonic transmitter 915 that is provided in the ultrasonic pen 91. The sewing machine 1 performs sewing on the specified position. Therefore, for example, the user's use of the pen tip 911 of the ultrasonic pen 91 to designate (press) the position on the work cloth 100 where the user wants to sew makes it possible for the sewing to be performed at the position that is designated on the work cloth 100.

The receiver 94 will be explained with reference to FIGS. 2 to 4. The receiver 95 has an identical structure to that of the receiver 94, so an explanation of the receiver 95 will be omitted. The lower left side, the upper right side, the upper left side, the lower right side, the top side, and the bottom side in FIG. 2 respectively define the front side, the rear side, the left side, the right side, the top side, and the bottom side of the receiver 94.

Figure 2:
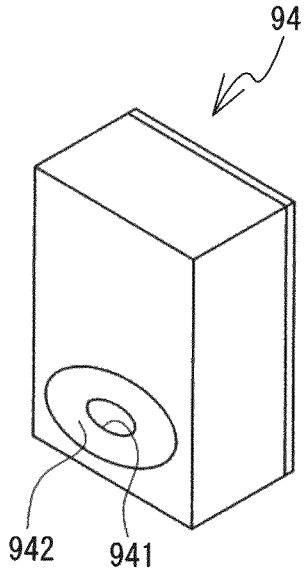
FIG. 2 is a perspective view of a receiver 94.
Figure 3:
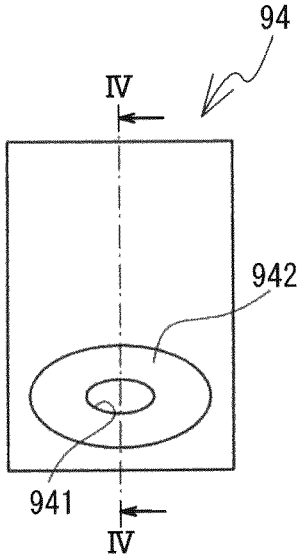
FIG. 3 is a front view of the receiver 94.
Figure 4:
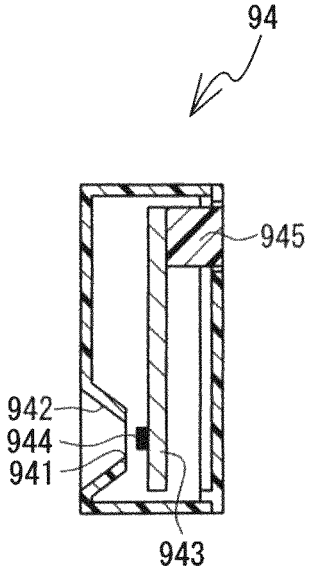
FIG. 4 is a section view of the receiver 94 in the direction of a line IV-IV that is shown in FIG. 3.

As shown in FIGS. 2 and 3, the shape of the receiver 94 has a rectangular parallelepiped shape that is slightly longer in the up-down direction. The receiver 94 is provided with an opening 941 in the center of the lower portion of its front face. The shape of the opening 941 is an ellipse whose long axis extends in the left-right direction. A wall portion 942 that surrounds the opening 941 is a tapered surface (an inclined surface) that becomes larger toward its outer side. As shown in FIG. 4, an electrical circuit board 943 and a microphone 944 are provided in the interior of the receiver 94. The microphone 944 is positioned on the inner side of the opening 941. A connector 945 is mounted on the rear face of the upper end of the electrical circuit board 943. The connector 945 is connected to a connector (not shown in the drawings) that is provided in the sewing machine 1.

Figure 5:
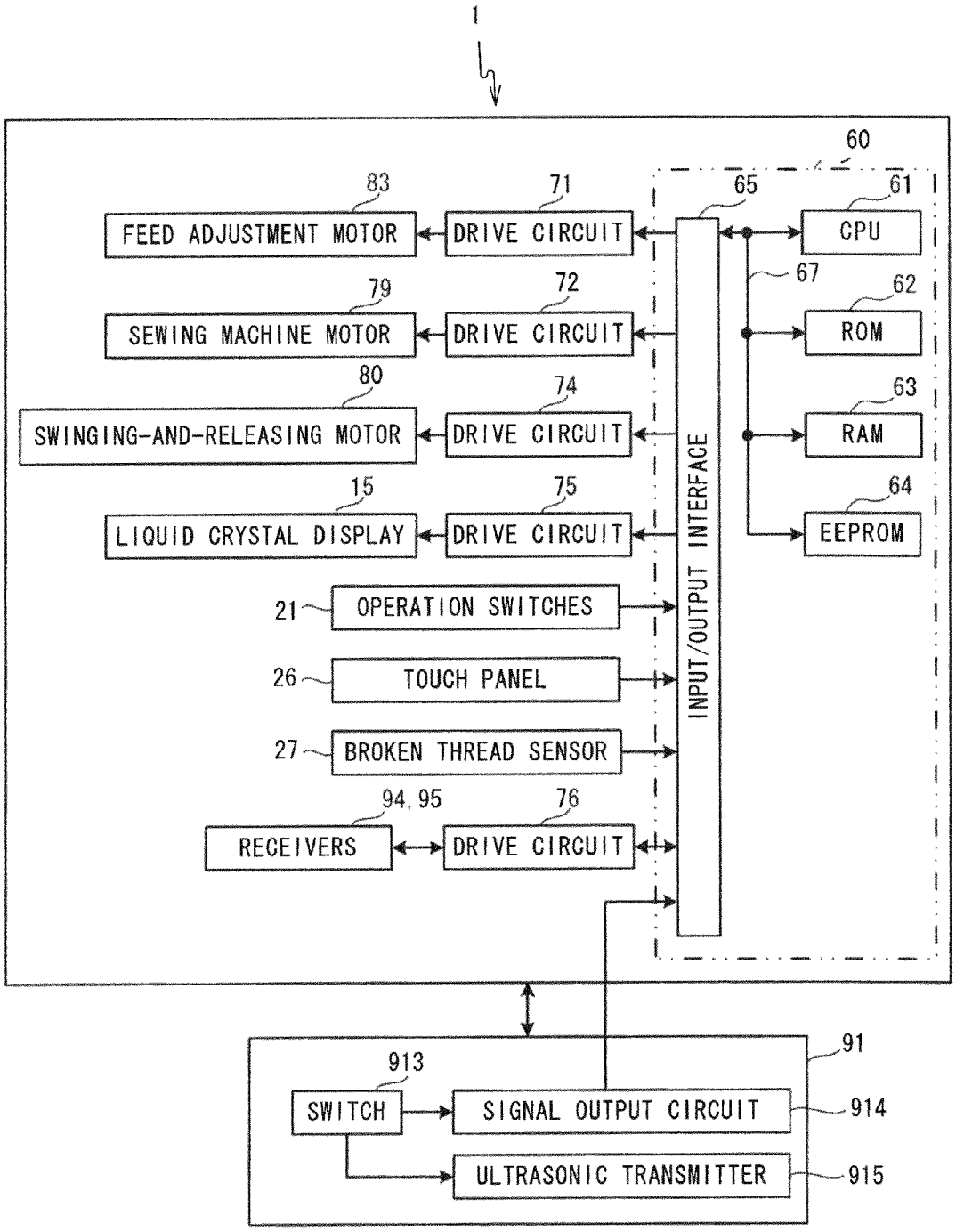
FIG. 5 is a block diagram that shows an electrical configuration of the sewing machine 1 according to the first embodiment.

The electrical configuration of the sewing machine 1 will be explained with reference to FIG. 5. A control portion 60 of the sewing machine 1 is provided with a CPU 61, a ROM 62, a RAM 63, an EEPROM 64, and an input/output interface 65. The CPU 61, the ROM 62, the RAM 63, the EEPROM 64, and the input/output interface 65 are connected to one another through a bus 67. Programs that the CPU 61 uses to perform processing, as well as data and the like, are stored in the ROM 62. Pattern data for a plurality of types sewing patterns and embroidery patterns that the sewing machine 1 uses to perform sewing are stored in the EEPROM 64. Note that the pattern data may also be stored in the ROM 62.

The operation switches 21, the touch panel 26, a broken thread sensor 27, and drive circuits 71, 72, 74, 75, 76 are electrically connected to the input/output interface 65. The drive circuit 71 drives the feed adjustment motor 83. The drive circuit 72 drives the sewing machine motor 79. The drive circuit 74 drives the swinging-and-releasing motor 80. The drive circuit 75 drives the LCD 15. The drive circuit 76 drives the receivers 94, 95. An amplifier circuit that is contained in the drive circuit 76 amplifies and transmits to the CPU 61 the ultrasonic wave signals that are detected by the receivers 94, 95.

The electrical configuration of the ultrasonic pen 91 will be explained. The ultrasonic pen 91 is provided with the switch 913, the signal output circuit 914, and the ultrasonic transmitter 915. The switch 913 is connected to the signal output circuit 914 and the ultrasonic transmitter 915. The signal output circuit 914 is connected to the input/output interface 65. The signal output circuit 914 outputs the electrical signal to the CPU 61 through the input/output interface 65.

Figure 6:
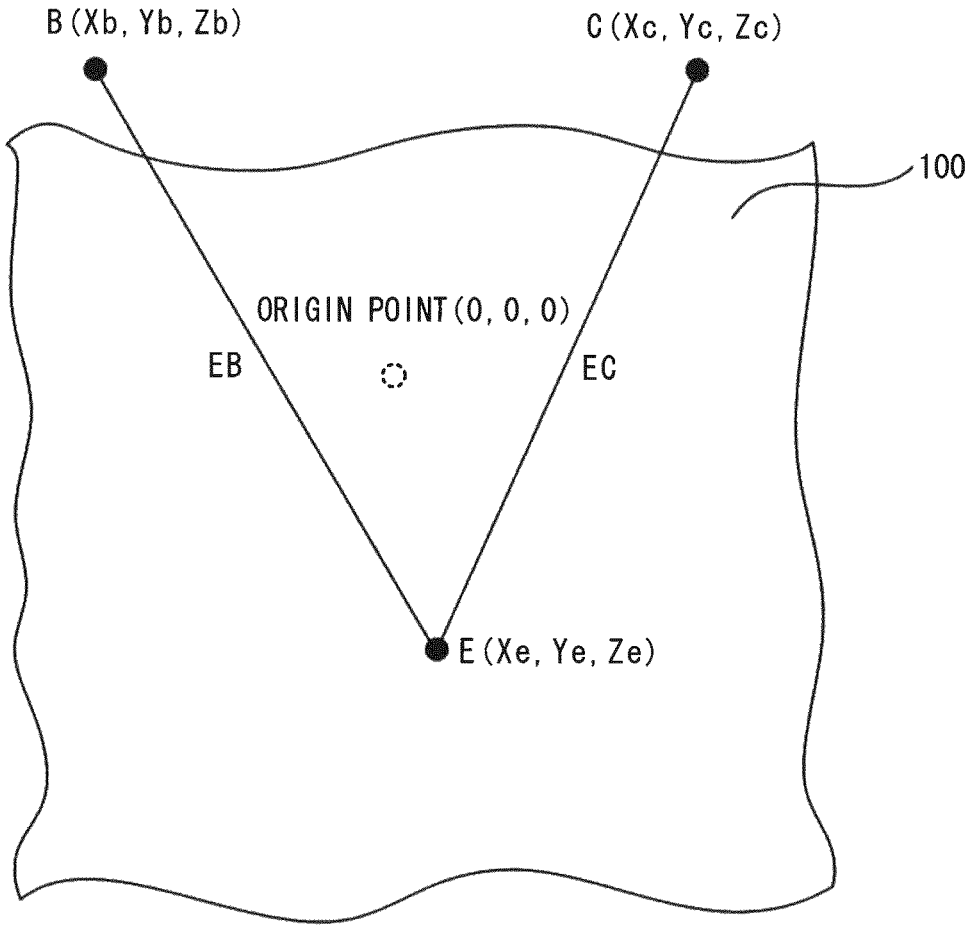
FIG. 6 is an explanatory figure of a method for computing designated coordinates E according to the first embodiment.

A method for specifying the position on the work cloth 100 that the user has designated by using the ultrasonic pen 91 will be explained with reference to FIG. 6. By pressing the pen tip 911 of the ultrasonic pen 91 against the work cloth 100, the user designates a specific position on the work cloth 100. Hereinafter, the position on the work cloth 100 against which the pen tip 911 of the ultrasonic pen 91 has been pressed is referred to as the designated position. Note that, as will be described later, the sewing machine 1 specifies the designated position by specifying the position of the transmission source of the ultrasonic waves. Therefore, strictly speaking, the position that is specified as the designated position is not the position on the work cloth 100 against which the pen tip 911 is pressed, but is the position of the ultrasonic transmitter 915 that is provided in the ultrasonic pen 91. However, the pen tip 911 and the ultrasonic transmitter 915 are located extremely close to one another. Therefore, the position of the ultrasonic transmitter 915 can be regarded as the position on the work cloth 100 against which the pen tip 911 is pressed, that is, as the designated position. Hereinafter, the left-right direction, the front-rear direction, and the up-down direction in the sewing machine 1 are respectively defined as the X axis direction, the Y axis direction, and the Z axis direction. The left-right direction and the up-down direction in FIG. 6 are respectively equivalent to the X axis direction and the Y axis direction, and the direction from the front to the rear in FIG. 6 is equivalent to the Z axis direction.

The sewing machine 1 specifies an X coordinate, a Y coordinate, and a Z coordinate of the designated position as coordinates (X, Y, Z). Here, a coordinate origin point (0, 0, 0) is defined as the center point of a hole (a needle hole) that is formed in the needle plate 34 (refer to FIG. 1) and through which the sewing needle passes. The plane on which the Z coordinate is zero indicates the top face of the needle plate 34. Coordinates B that indicate the position of the receiver 94 are defined as (Xb, Yb, Zb). Coordinates C that indicate the position of the receiver 95 are defined as (Xc, Yc, Zc). Coordinates E that indicate the designated position are defined as (Xe, Ye, Ze). The respective Z coordinates of the receivers 94, 95 indicate the heights of the receivers 94, 95 in relation to the top face of the needle plate 34. The coordinates B (Xb, Yb, Zb) and the coordinates C (Xc, Yc, Zc) are stored in the ROM 62 in advance. Hereinafter, the coordinates E is referred to as the designated coordinates E. The distance between the designated coordinates E and the coordinates B is referred to as the distance EB. The distance between the designated coordinates E and the coordinates C is referred to as the distance EC.

Based on the Pythagorean theorem, the distances EB, EC can be described by the coordinates B, C, E. The relationship between the distance EB and the coordinates B, C, E is described by Formula (1) below. In the same manner, the relationship between the distance EC and the coordinates B, C, E is described by Formula (2) below.

$$(Xb-Xe)^2+(Yb-Ye)^2+(Zb-Ze)^2=(EB)^2 \quad (1)$$

$$(Xc-Xe)^2+(Yc-Ye)^2+(Zc-Ze)^2=(EC)^2 \quad (2)$$

Formula (1) is identical to an Formula for a spherical surface (with a radius of the distance EB) for which the coordinates B define the origin point and that intersects the designated coordinates E. Formula (2) is identical to an Formula for a spherical surface (with a radius of the distance EC) for which the coordinates C define the origin point and that intersects the designated coordinates E.

The velocity at which ultrasonic waves travel is the sonic velocity V. The time elapsing between when the ultrasonic waves are transmitted from the ultrasonic pen 91 that is at the designated coordinates E and when the ultrasonic waves are arrived at the receiver 94 is defined as an arrival time Tb. The time elapsing between when the ultrasonic waves are transmitted from the ultrasonic pen 91 that is at the designated coordinates E and when the ultrasonic waves are arrived at the receiver 95 is defined as an arrival time Tc. In a case that is based on the conditions described above, the distances EB, EC can respectively be described by Formulas (3) and (4) below.

$$EB=V\times Tb \quad (3)$$

$$EC=V\times Tc \quad (4)$$

Substituting Formulas (3) and (4) into Formulas (1) and (2) yields Formulas (5) and (6) below.

$$(Xb-Xe)^2+(Yb-Ye)^2+(Zb-Ze)^2=(V\times Tb)^2 \quad (5)$$

$$(Xc-Xe)^2+(Yc-Ye)^2+(Zc-Ze)^2=(V\times Tc)^2 \quad (6)$$

In Formulas (5) and (6), the coordinates B (Xb, Yb, Zb), the coordinates C (Xc, Yc, Zc) and the sonic velocity V are known values, and they are stored in the ROM 62 in advance. The arrival times Tb, Tc are specified by computing the difference between the time that the ultrasonic waves are transmitted from the ultrasonic transmitter 915 of the ultrasonic pen 91

(hereinafter referred as the transmission time T1) and the time that the ultrasonic waves are detected by the receivers 94, 95 (hereinafter referred as the detection time T2). Among the designated coordinates E (Xe, Ye, Ze), the value of Ze, which is specified according to the thickness of the work cloth 100, is so small in comparison to the ranges of values that Xe and Ye can respectively have that the value of Ze can be ignored, so the value of Ze can be regarded as being zero. Accordingly, the respective values for Xe and Ye are computed by solving the simultaneous Formulas (5) and (6). In this manner, the designated coordinates E (Xe, Ye, Ze (=0)) that the user has used the ultrasonic pen 91 to designate on the work cloth 100 are computed.

In the first embodiment, by pressing the pen tip 911 of the ultrasonic pen 91 against the work cloth 100, the user can designate for the sewing machine 1 a position where the sewing on the work cloth 100 will start (hereinafter referred as the starting position) and a position where the sewing on the work cloth 100 will end (hereinafter referred as the ending position). The sewing machine 1 detects the ultrasonic waves that are transmitted by the ultrasonic pen 91 and specifies the designated position based on the time that the ultrasonic waves were detected. The sewing machine 1 recognizes the specified designated position as one of the starting position and the ending position. The sewing machine 1 performs the sewing based on one of the starting position and the ending position. Hereinafter, the processing for performing the sewing will be explained in detail.

Figure 7:
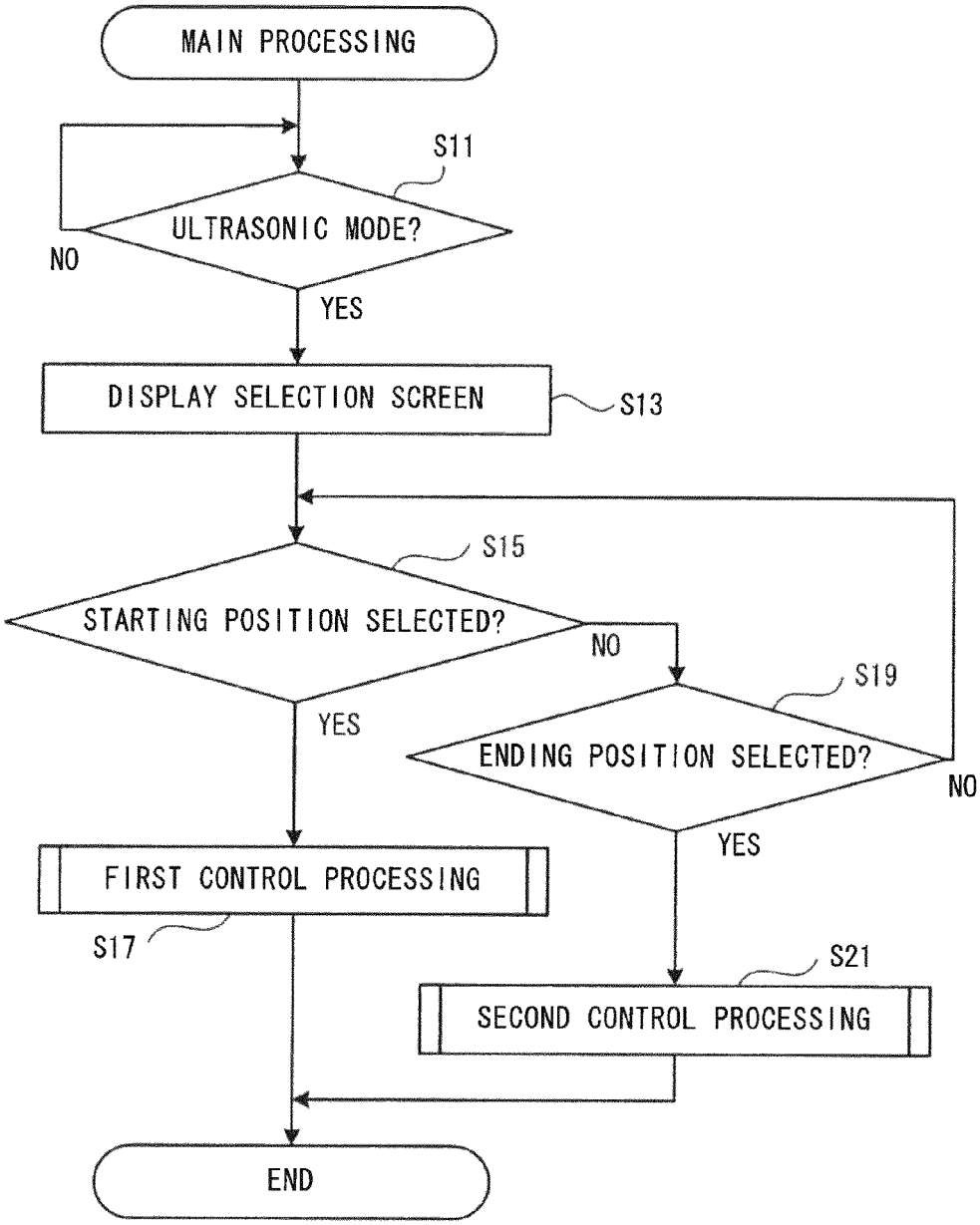
FIG. 7 is a flowchart that shows main processing according to the first embodiment.
Figure 8:
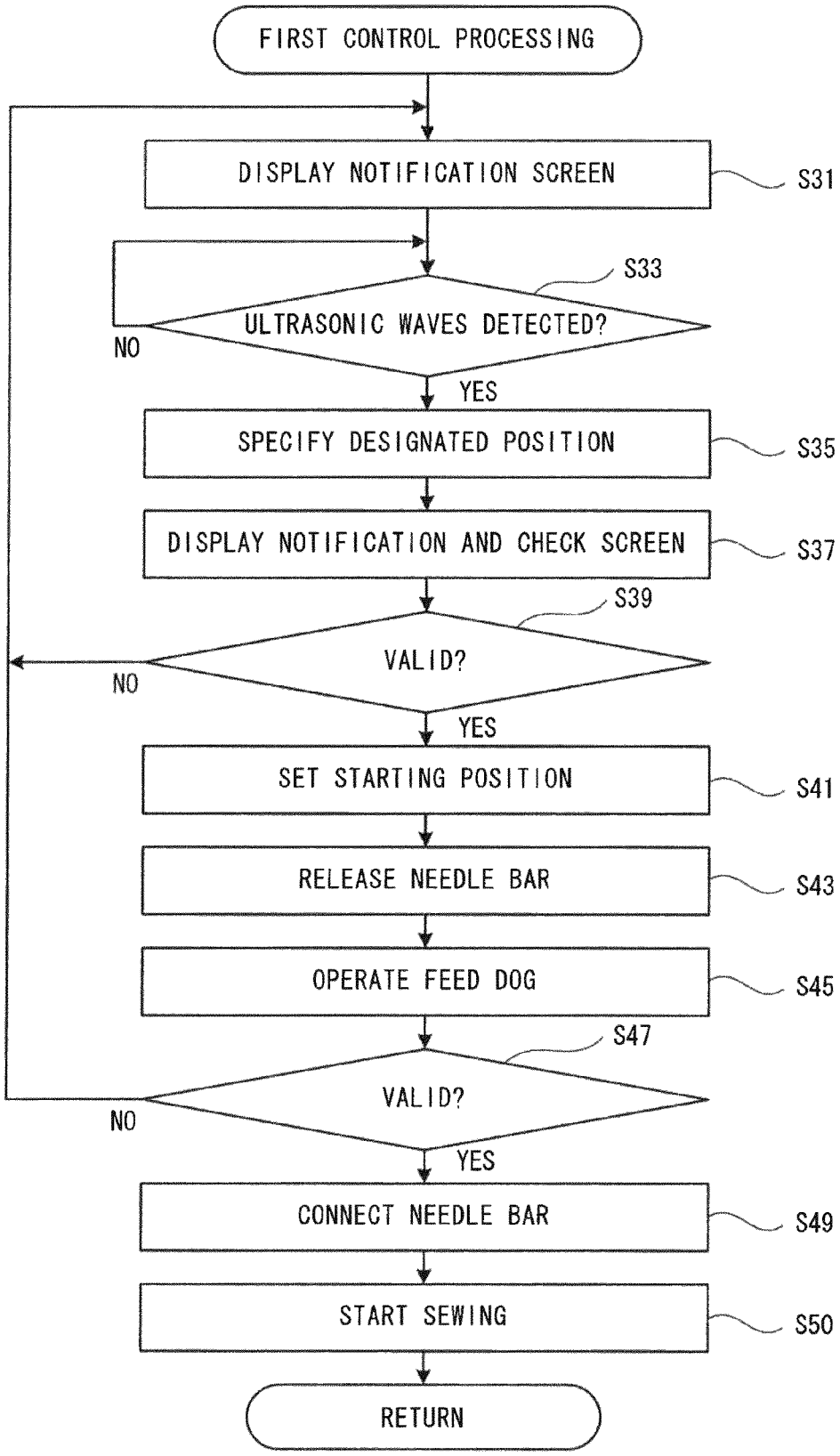
FIG. 8 is a flowchart that shows first control processing according to the first embodiment.
Figure 9:
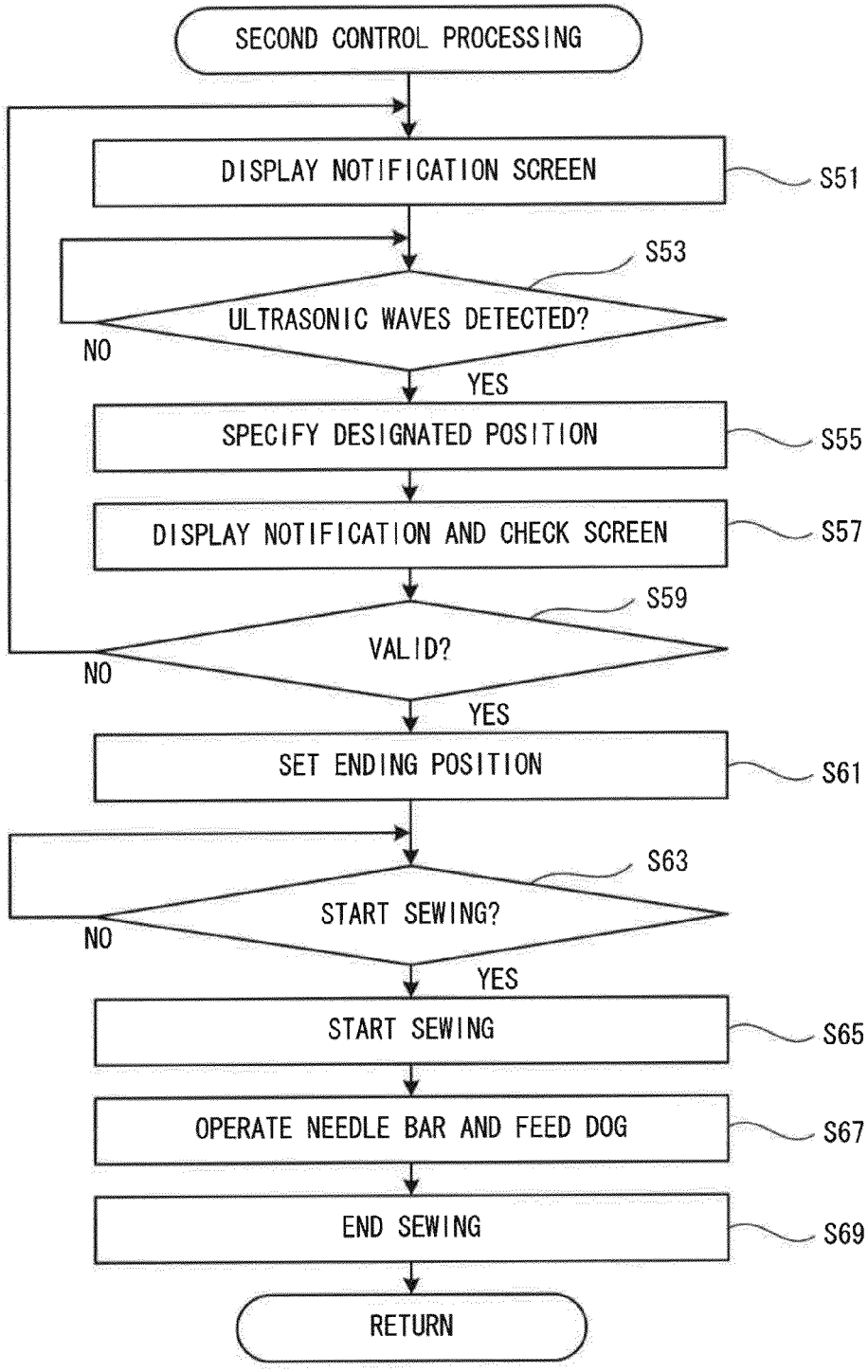
FIG. 9 is a flowchart that shows second control processing according to the first embodiment.

Main processing will be explained with reference to FIGS. 7 to 9. The main processing is performed by the CPU 61 in accordance with a program that is stored in the ROM 62. The CPU 61 starts the main processing when, for example, the user has used a panel operation to input a command to perform sewing on the work cloth 100. Note that a straight line stitch, a zigzag stitch, a decorative stitch, and the like may be cited as examples of the sewing patterns.

The CPU 61 determines whether a panel operation is detected that issues a command to shift to an operating mode (hereinafter referred as the ultrasonic mode) that uses the ultrasonic pen 91 (Step S11). In a case where the panel operation that issues the command to shift to the ultrasonic mode is not detected (NO at Step S11), the processing returns to Step S11.

In a case where the panel operation that issues the command to shift to the ultrasonic mode is detected (YES at Step S11), the CPU 61 displays on the LCD 15 a selection screen for selecting one of the starting position and the ending position (Step S13). The CPU 61 determines whether a panel operation that selects the starting position is detected (Step S15). In a case where the panel operation that selects the starting position is detected (YES at Step S15), the CPU 61 specifies the designated position and performs processing (first control processing; refer to FIG. 8) that starts the sewing from the starting position (Step S17). The first control processing will be described in detail later. After the first control processing is terminated, the main processing is terminated. In contrast, in a case where the panel operation that selects the starting position is not detected (NO at Step S15), the CPU 61 determines whether a panel operation that selects the ending position is detected (Step S19). In a case where the panel operation that selects the ending position is detected (YES at Step S19), the CPU 61 specifies the designated position and performs processing (second control processing; refer to FIG. 9) that performs the sewing up to the ending position (Step S21). The second control processing will be described in detail later. After the second control processing is terminated, the main processing is terminated. In a case where the panel operation that selects the ending position is not detected (NO at Step S19), the processing returns to Step S15.

The first control processing will be explained with reference to FIG. 8. The CPU 61 displays on the LCD 15 a screen that notifies the user that an operating mode is in effect in which the starting position is designated using the ultrasonic pen 91 (Step S31). The CPU 61 determines whether the ultrasonic wave is detected through the receivers 94, 95 (Step S33). In a case where the ultrasonic wave is not detected through the receivers 94, 95 (NO at Step S33), the processing returns to Step S33.

In order to designate the starting position, the user presses the pen tip 911 of the ultrasonic pen 91 against the work cloth 100. The signal output circuit 914 of the ultrasonic pen 91 outputs the electrical signal through the cable 912. At the same time, the ultrasonic transmitter 915 of the ultrasonic pen 91 transmits the ultrasonic waves. The CPU 61 detects the electrical signal that has been output from the ultrasonic pen 91 through the cable 912. The CPU 61 specifies the time when the electrical signal was detected as the transmission time T1. After specifying the transmission time T1, the CPU 61 detects the ultrasonic waves through the receivers 94, 95. The CPU 61 specifies the time when the ultrasonic waves were detected as the detection time T2.

In a case where the ultrasonic wave is detected through the receivers 94, 95 (YES at Step S33), the CPU 61 specifies the designated position by computing the designated coordinates E based on the transmission time T1and the detection time T2 (Step S35). The designated position that is specified is the starting position. The CPU 61 displays a screen on the LCD 15 that notifies the user that the starting position is specified and allows the user to check whether the designated position that was specified is valid or not (Step S37). After the user has checked the content that is displayed on the LCD 15, the user performs a panel operation to input to the sewing machine 1 whether the starting position is valid or not, that is, whether the starting position is right or wrong.

The CPU 61 determines whether a panel operation that defines the starting position as valid is detected (Step S39). In a case where a panel operation that defines the starting position as invalid is detected (NO at Step S39), the processing for specifying the designated position will be performed again from the beginning, so the processing returns to Step S31. On the other hand, in a case where the panel operation that defines the starting position as valid is detected (YES at Step S39), the CPU 61 sets, as the starting position, the designated position that was specified at Step S35 (Step S41).

The CPU 61 operates the swinging-and-releasing motor 80 in order to put the needle bar release mechanism into the released state. The needle bar release mechanism, which has been put into the released state, cuts off the driving force that is transmitted from the needle bar drive mechanism and releases the needle bar 29 (Step S43). The needle bar 29 enters a state in which it is held at its highest position in the up-down direction without being operated, even if the sewing machine motor 79 operates. The CPU 61 operates the feed dog and moves the work cloth 100 such that the position that is indicated by the X coordinate Xe and the Y coordinate Ye of the designated coordinates E that were specified at Step S35, that is, the starting position, becomes coincident with a needle drop point (Step S45). Note that because the needle bar 29 has been released and is held at its highest position, a stitch is not formed in the work cloth 100. The work cloth 100 is moved as described above, and the starting position is in a state in which it is coincident with the needle drop point. Here, the needle drop point is the point where the sewing needle pierces the work cloth 100, and it is the center point of the needle hole that is formed in the needle plate 34.

The user visually checks whether the desired starting position is coincident with the needle drop point, then performs a panel operation to input to the sewing machine 1 whether the starting position is valid or not, that is, whether the starting position is right or wrong.

The CPU 61 determines whether the panel operation that defines the starting position as valid is detected (Step S47). In a case where a panel operation that defines the starting position as invalid is detected (NO at Step S47), the processing for specifying the designated position will be performed again from the beginning, so the processing returns to Step S31. On the other hand, in a case where the panel operation that defines the starting position as valid is detected (YES at Step S47), the CPU 61 operates the swinging-and-releasing motor 80, and the needle bar release mechanism connects the needle bar drive mechanism and the needle bar 29 such that the driving force is transmitted from the needle bar drive mechanism to the needle bar 29 (Step S49). Next, when the user operates the start-and-stop switch that is provided in the lower portion of the front face of the arm 13, the CPU 61 operates the feed dog at the same time that it operates the sewing machine motor 79 to move the needle bar 29 up and down through the operation of the needle bar drive mechanism. The sewing on the work cloth 100 is thus started from the starting position (Step S50). Then the first control processing is terminated, and the processing returns to the main processing (refer to FIG. 7).

Next, the second control processing will be explained with reference to FIG. 9. The second control processing is processing that sets the ending position (Step S61), and it sets the ending position by performing the same sort of processing that is performed to set the starting position in the first control processing. Therefore, explanations will be omitted for the processing up to the setting of the ending position (Steps S51 to S61).

After the ending position is set at Step S61, the CPU 61 determines whether the start-and-stop switch is operated (Step S63). In a case where the start-and-stop switch has not been operated (NO at Step S63), the processing returns to Step S63. In a case where the start-and-stop switch is operated (YES at Step S63), the CPU 61 starts operating the sewing machine motor 79 to start driving the needle bar 29 and the feed dog. That causes the sewing on the work cloth 100 to be started (Step S65).

The needle bar 29 and the feed dog are operated (Step S67), and the sewing is performed on the work cloth 100. Then when the needle drop point gradually approaches and becomes coincident with the position that is indicated by the X coordinate Xe and the Y coordinate Ye of the designated coordinates E that were specified at Step S55, that is, the ending position, the CPU 61 stops the operation of the sewing machine motor 79 to stop the driving of the needle bar 29 and the feed dog. In this manner, the sewing is ended at the ending position that the user designated (Step S69). Then the second control processing is terminated, and the processing returns to the main processing.

As explained above, in a case where the user has used the ultrasonic pen 91 to designate a position on the work cloth 100, the sewing machine 1 moves the work cloth 100 based on the designated position. Therefore, the user is easily able to perform sewing work in the desired sewing position simply by designating the desired position on the work cloth 100.

In the first embodiment, simply by using the ultrasonic pen 91 to designate the desired starting position, the user is able to indicate the starting position for the sewing to the sewing machine 1, and is able to start the sewing immediately from the desired starting position. In addition, simply by using the ultrasonic pen 91 to designate the desired ending position, the user is able to indicate the ending position for the sewing to the sewing machine 1, and is able to end the sewing reliably after the sewing is performed up to the desired ending position.

Second Embodiment

Figure 10:
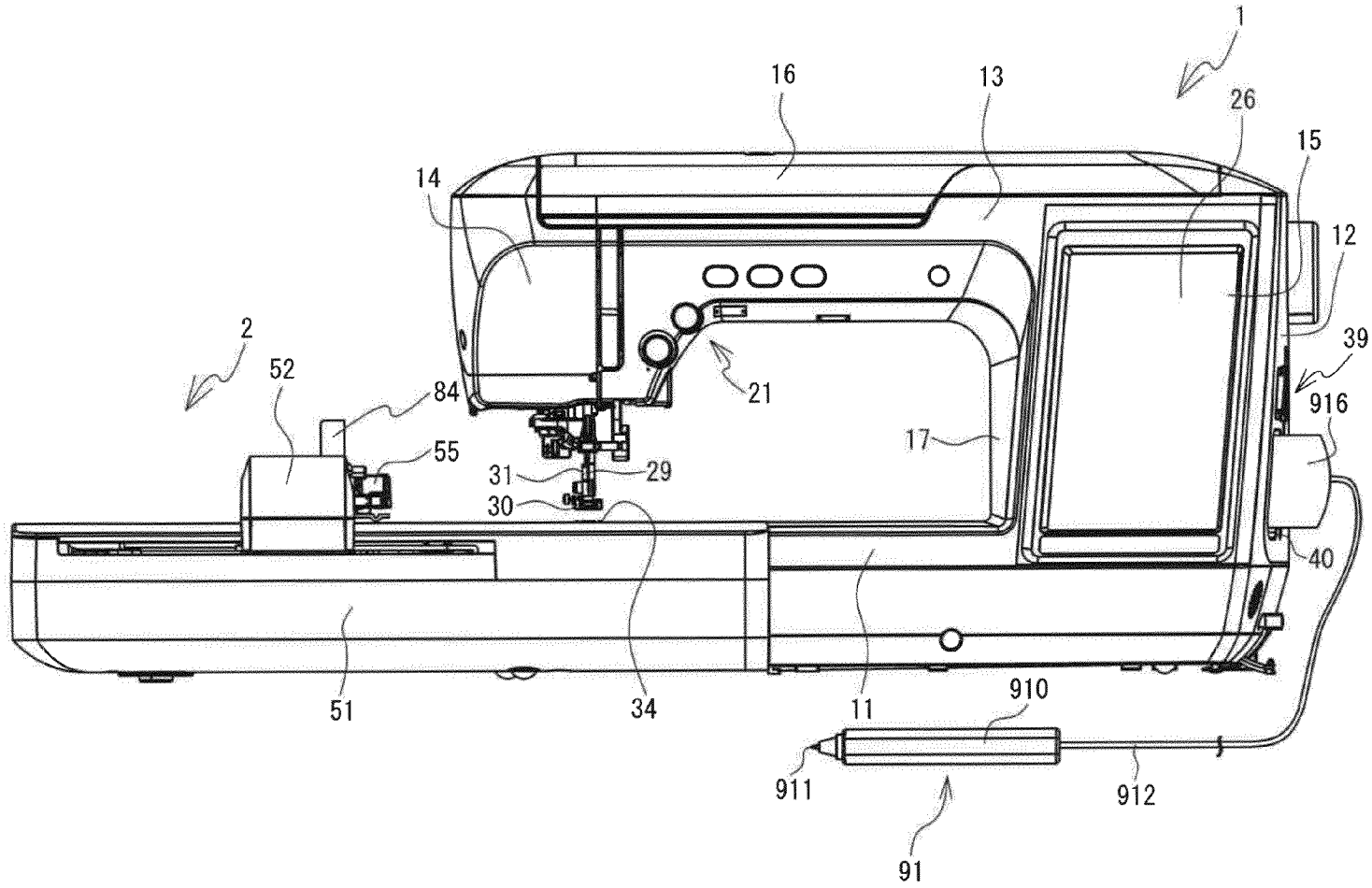
FIG. 10 is a front view of the sewing machine 1 according to a second embodiment.
Figure 11:
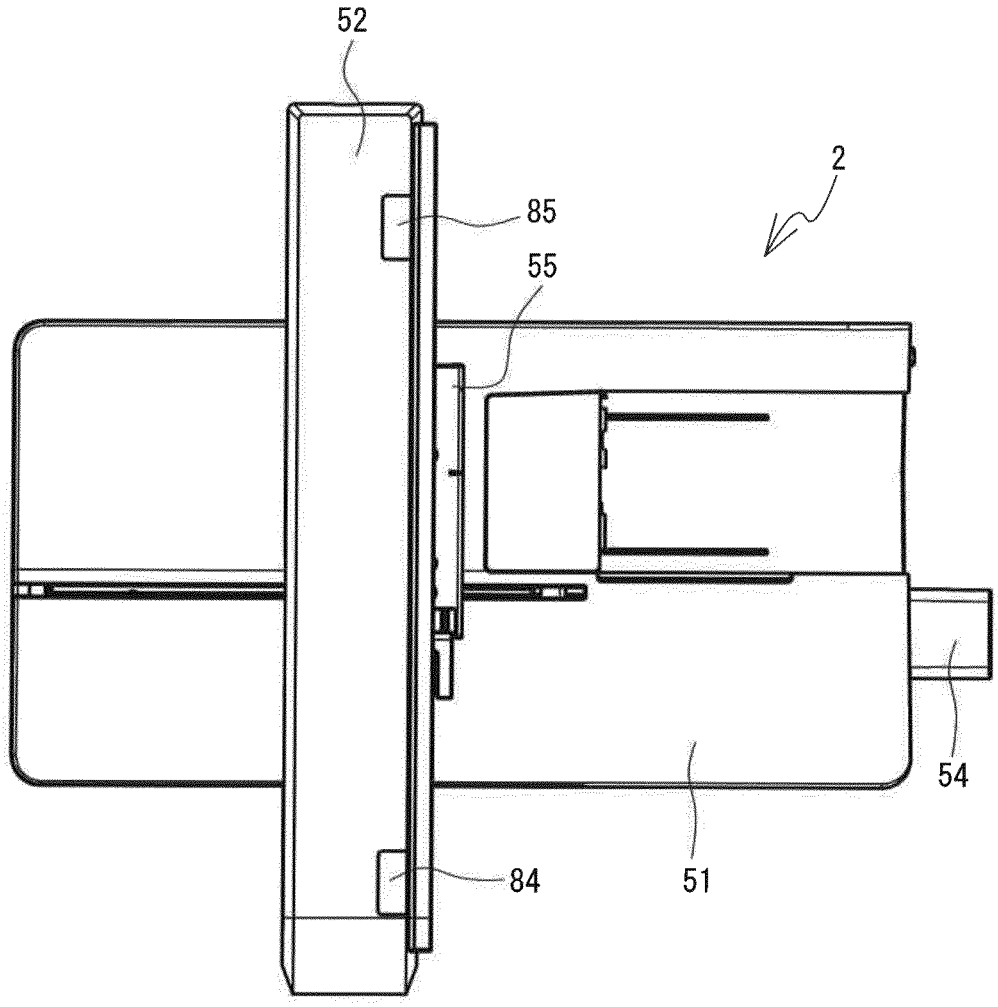
FIG. 11 is a plan view of an embroidery device 2.
Figure 12:
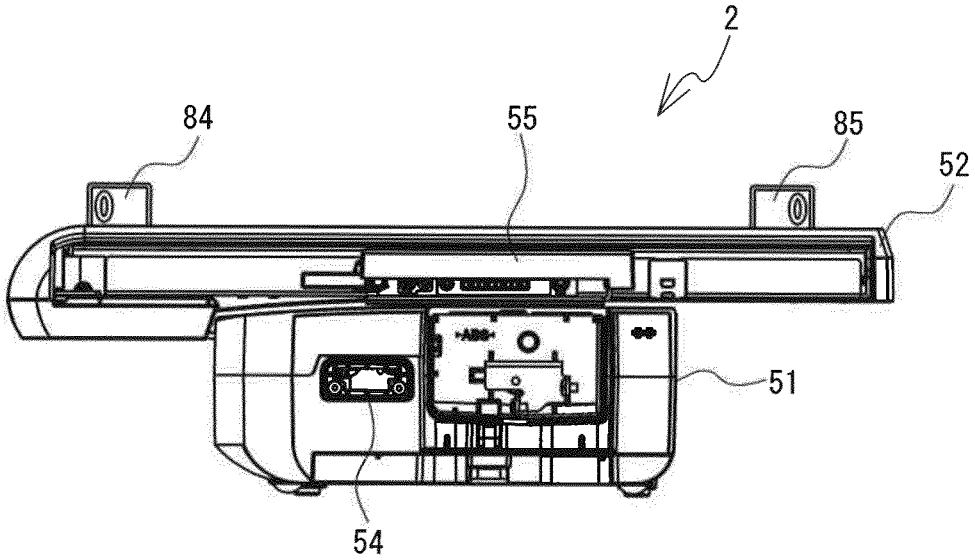
FIG. 12 is a right side view of the embroidery device 2.

A second embodiment will be explained. In the second embodiment, receivers 84, 85 are provided, not in the sewing machine 1, but in the embroidery device 2 that is removably mounted on the bed 11 of the sewing machine 1 (in FIG. 10, only the receiver 84, which is on the front side, is shown). In FIGS. 11 and 12, the embroidery device 2 is shown in a state in which it is not mounted on the sewing machine 1. The embroidery device 2 is provided with a body 51 and a carriage 52.

As shown in FIGS. 11 and 12, the body 51 of the embroidery device 2 is provided with a connecting portion 54 on its right side face. In a state in which the embroidery device 2 is mounted on the sewing machine 1, the connecting portion 54 connects to a socket portion (not shown in the drawings) of the sewing machine 1, such that the embroidery device 2 is electrically connected to the sewing machine 1.

The carriage 52 is provided on the top side of the body 51. The carriage 52 has a rectangular parallelepiped shape that is long in the front-rear direction. The carriage 52 is provided with a frame holder 55, a Y axis moving mechanism (not shown in the drawings), and a Y axis motor (not shown in the drawings). The frame holder 55 is a holder on which an embroidery frame can be removably mounted. The frame holder 55 is provided on the right side face of the carriage 52. The embroidery frame is a known frame that is configured from an inner frame and an outer frame and that holds the work cloth 100 by clamping it. The work cloth 100 that is held in the embroidery frame is positioned on the top side of the bed 11 and below the needle bar 29 and the presser foot 30. The Y axis moving mechanism moves the frame holder 55 in the front-rear direction (the Y axis direction). The embroidery frame moves the work cloth 100 in the front-rear direction in conjunction with the moving of the frame holder 55 in the front-rear direction. The Y axis motor drives the Y axis moving mechanism. The CPU 61 (refer to FIG. 5) controls the Y axis motor.

An X axis moving mechanism (not shown in the drawings) and an X axis motor (not shown in the drawings) that move the carriage 52 in the left-right direction (the X axis direction) are provided in the interior of the body 51. The embroidery frame moves the work cloth 100 in the left-right direction in conjunction with the moving of the carriage 52 in the left-right direction. The X axis motor drives the X axis moving mechanism. The CPU 61 controls the X axis motor.

The receiver 84 is provided near the front end of the top face of the carriage 52. The receiver 85 is provided near the rear end of the top face of the carriage 52. The receivers 84, 85 receive ultrasonic waves. The structures of the receivers 84, 85 are identical to those of the receivers 94, 95. Because the embroidery frame is provided on the right side face of the carriage 52, the receivers 84, 85 are positioned higher than the work cloth 100 that is held in the embroidery frame, that is, the receivers 84, 85 are positioned on the opposite side of the work cloth 100 from the side where the bed 11 is provided. The openings in the receivers 84, 85 face to the right. When the ultrasonic waves are received by the receivers 84, 85, the receivers 84, 85 transmit electrical signals to the sewing machine 1. By receiving the electrical signals from the receivers 84, 85, the CPU 61 detects the ultrasonic waves that are transmitted from the ultrasonic pen 91.

By pressing the pen tip 911 of the ultrasonic pen 91 against the work cloth 100 that is held in the embroidery frame, the user can designate for the sewing machine 1 the position (including the angle) where an embroidery pattern will be sewn on the work cloth 100. Hereinafter, the position where the embroidery pattern will be sewn is referred to as the pattern position. The sewing machine 1 detects, through the receivers 84, 85 of the embroidery device 2, the ultrasonic waves that are transmitted from the ultrasonic pen 91 and specifies the designated position based on the detected ultrasonic waves. The sewing machine 1 recognizes the specified designated position as the pattern position. The sewing machine 1 performs the sewing of the embroidery pattern on the specified pattern position. The processing for performing the sewing will now be explained in detail.

Figure 14:
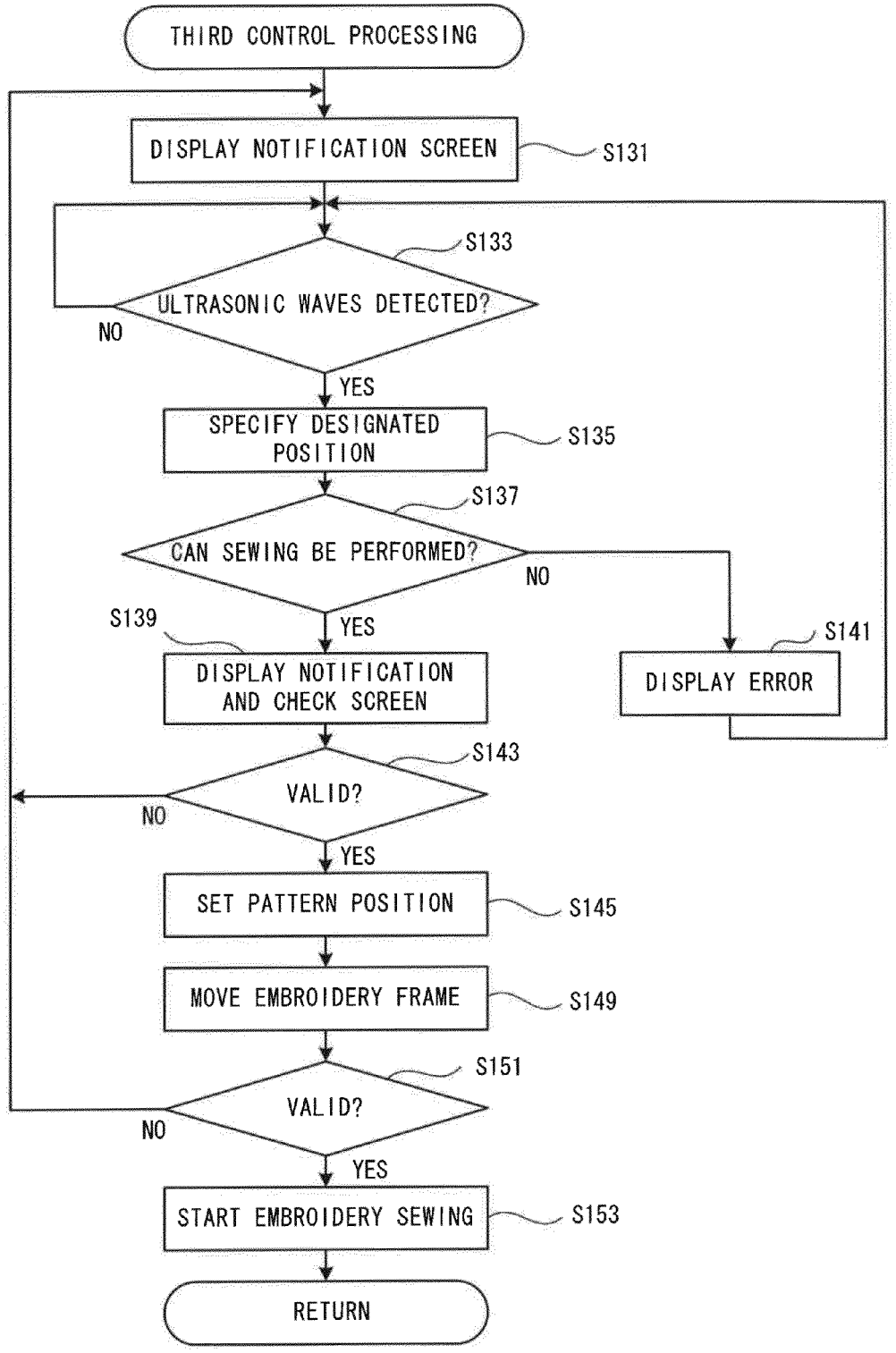
FIG. 14 is a flowchart that shows third control processing according to the second embodiment.
Figure 15:
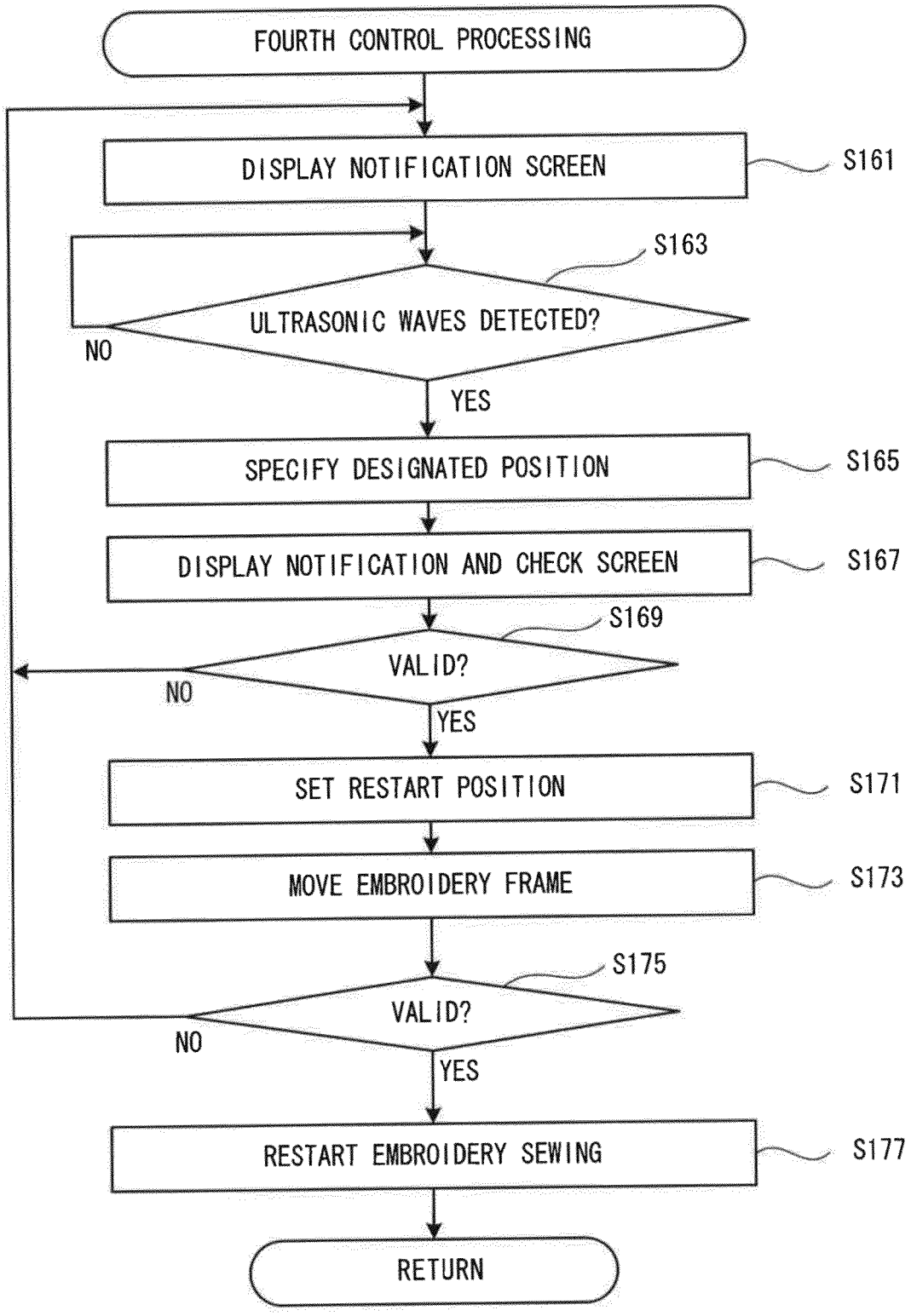
FIG. 15 is a flowchart that shows fourth control processing according to the second embodiment.

Main processing will be explained with reference to FIGS. 13 to 15. The main processing is performed by the CPU 61 in accordance with a program that is stored in the ROM 62. The CPU 61 starts the main processing in a case where, for example, the user has used a panel operation to input a command to perform the sewing of the embroidery pattern.

The CPU 61 determines whether the panel operation is detected that issues a command to shift to the ultrasonic mode (Step S111). In a case where the panel operation that issues the command to shift to the ultrasonic mode is not detected (NO at Step S111), the processing returns to Step S111. In a case where the panel operation that issues the command to shift to the ultrasonic mode is detected (YES at Step S111), the CPU 61 displays on the LCD 15 a setting screen for making settings for the size of the embroidery pattern and its angle (in relation to the work cloth 100) (Step S113). The CPU 61 determines whether a panel operation is detected that makes the settings that are described above (Step S115). Note that it is assumed that the user has selected a desired embroidery pattern, that is, the embroidery pattern that the user wants to be sewn, prior to the shift to the ultrasonic mode.

Figure 16:
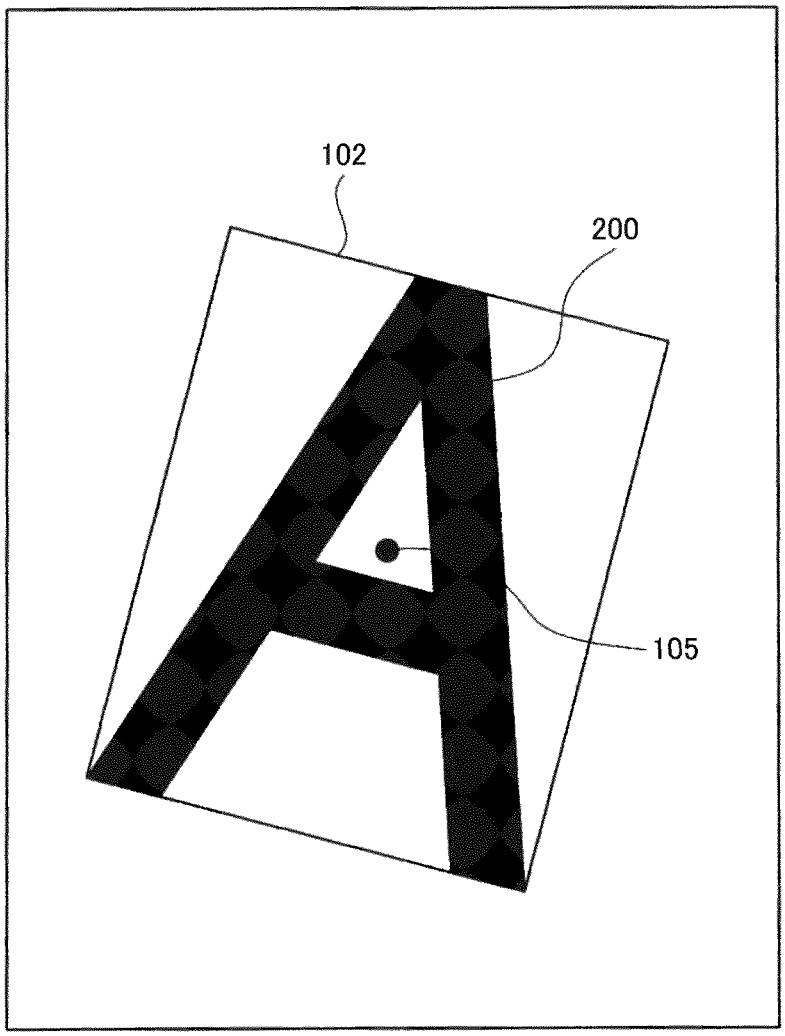
FIG. 16 is a figure that shows a character "A" 200 that is displayed on an LCD 15.

FIG. 16 shows an example of the setting screen that is displayed on the LCD 15. A character "A" 200 is displayed on the LCD 15 as the embroidery pattern that the user selected by a panel operation. In this case, the size of the character "A" 200 is left at the default value, and the angle is set such that all of the embroidery data will be rotated around a reference point 105 approximately 15 degrees clockwise from the default value (zero degrees). Here, the embroidery data for the character "A" 200 include data (referred as mask data) and reference point data. The mask data describes the virtual rectangle, which is the smallest rectangle that can enclose the character "A" 200. The reference point data defines the center point of the virtual rectangle (the point of intersection of the diagonals of the rectangle) as the reference point 105. The reference point 105 and a rectangular outline 102 that indicates the mask data are displayed along with the character "A" 200 on the LCD 15. Note that it is not necessary for the reference point 105 to be the center point of the virtual rectangle, and it may also be one of the four vertices of the virtual rectangle, for example.

Note that a setting that changes the size of the character "A" 200 may also be made by a panel operation by the user. The default values for the size and the angle of the embroidery pattern may also be used without being changed.

Next, in a case where a panel operation is detected that indicates that the settings that are described above have been completed (YES at Step S115), the CPU 61 performs processing (third control processing; refer to FIG. 14) that controls the embroidery device 2 and performs the sewing of the embroidery pattern in the designated position (Step S117). In a case where the panel operation that indicates that the settings that are described above have been completed is not detected (NO at Step S115), the processing returns to Step S115.

The third control processing will be explained with reference to FIG. 14. The CPU 61 displays on the LCD 15 a screen that notifies the user that an operating mode is in effect in which the pattern position is designated using the ultrasonic pen 91 (Step S131). The CPU 61 determines whether the receivers 84, 85 of the embroidery device 2 have detected (received) the ultrasonic waves (Step S133). In a case where the receivers 84, 85 have not detected the ultrasonic waves (NO at Step S133), the processing returns to Step S133.

In a case where the user has pressed the pen tip 911 of the ultrasonic pen 91 against the work cloth 100 in order to designate the pattern position, the signal output circuit 914 of the ultrasonic pen 91 outputs the electrical signal through the cable 912. At the same time, the ultrasonic transmitter 915 of the ultrasonic pen 91 transmits the ultrasonic waves. The CPU 61 detects the electrical signal that has been output from the ultrasonic pen 91 through the cable 912. The CPU 61 specifies the time when the electrical signal was detected as the transmission time T1. Thereafter, the receivers 84, 85 receive the ultrasonic waves. The receivers 84, 85 output electrical signals to the sewing machine 1. The CPU 61 specifies the time when the electrical signals that were output from the receivers 84, 85 were detected as the detection time T2.

In a case where it is determined that the receivers 84, 85 have received the ultrasonic waves (YES at Step S133), the CPU 61 specifies the designated position by computing the designated coordinates E based on the transmission time T1 and the detection time T2 (Step S135). The designated position that is specified is equivalent to the pattern position. The CPU 61 positions the reference point 105 at the pattern position (refer to FIG. 16) and determines whether the embroidery pattern can be sewn on the work cloth 100 using the size and the angle that were set at Step S115 (refer to FIG. 13). In other words, the CPU 61 determines whether the embroidery pattern is located within an area of the work cloth 100 in which the sewing can be performed, the work cloth 100 being held in the embroidery frame. In a case where the embroidery pattern is not located within an area in which the sewing can be performed, the CPU 61 determines that the embroidery pattern cannot be sewn using the conditions that were set at Step S115 (refer to FIG. 13) (NO at Step S137). The CPU 61 displays on the LCD 15 an error message that notifies the user that the sewing of the embroidery pattern cannot be performed (Step S141). Then the processing returns to Step S133.

On the other hand, in a case where it is determined that the embroidery pattern is located within an area in which the sewing can be performed (YES at Step S137), the CPU 61 displays on the LCD 15 a screen that provides notification that the embroidery pattern is located within an area in which the sewing can be performed and allows the user to check whether the pattern position is valid (Step S139). Using the screen that is displayed on the LCD 15, the user performs a panel operation to input to the sewing machine 1 whether the pattern position is valid or not (whether the pattern position is right or wrong).

The CPU 61 determines whether a panel operation that defines the pattern position as valid is detected (Step S143). In a case where a panel operation that defines the pattern position as invalid is detected (NO at Step S143), the processing for specifying the designated position will be performed again from the beginning, so the processing returns to Step S131. On the other hand, in a case where the panel operation that defines the pattern position as valid is detected (YES at Step S143), the CPU 61 sets, as the pattern position, the designated position that was specified at Step S135 (Step S145).

The CPU 61 operates the X axis motor and the Y axis motor of the embroidery device 2 to move the embroidery frame such that the position that is indicated by the X coordinate Xe and the Y coordinate Ye of the designated coordinates E that were specified at Step S135, that is, the pattern position, becomes coincident with the needle drop point (Step S149). The user visually checks the pattern position, then performs a panel operation to input to the sewing machine 1 whether the pattern position is valid or not, (whether the pattern position is right or wrong).

The CPU 61 determines whether the panel operation that defines the pattern position as valid is detected (Step S151). In a case where a panel operation that defines the pattern position as invalid is detected (NO at Step S151), the processing for specifying the designated position will be performed again from the beginning, so the processing returns to Step S131. On the other hand, in a case where the panel operation that defines the pattern position as valid is detected (YES at Step S151), the CPU 61 operates the sewing machine motor 79 to move the needle bar 29 up and down and controls the embroidery device 2 to move the embroidery frame. That starts the sewing of the embroidery pattern in the designated pattern position on the work cloth 100 that is held in the embroidery frame (Step S153). The third control processing is terminated, and the processing returns to the main processing (refer to FIG. 13).

As described above, simply by using the ultrasonic pen 91 to designate the desired position on the work cloth 100, the user is able to set the pattern position of the embroidery pattern for the sewing machine 1, and is able to make the sewing machine 1 to sew the embroidery pattern in the desired pattern position.

The sewing machine 1 according to the present embodiment is also provided with the broken thread sensor 27 (refer to FIG. 5), which monitors the state of the upper thread while the sewing is in progress. The broken thread sensor 27 detects whether the upper thread has broken for any reason during the sewing. The broken thread sensor 27 is a sensor with a known structure, so a detailed explanation will be omitted. As shown in FIG. 13, in a case where a break in the upper thread is detected by the broken thread sensor 27 during the sewing of the embroidery pattern (YES at Step S121), the CPU 61 stops the sewing machine motor 79 and also controls the embroidery device 2 to stop the moving of the embroidery frame. Thus, when the upper thread breaks, the sewing of the embroidery pattern on the work cloth 100 is suspended.

However, there is a time lag from when the broken thread sensor 27 detects that the upper thread is broken to when the operations of the sewing machine motor 79 and the embroidery device 2 stop completely, so the needle drop point advances (overruns) by the equivalent of a plurality of stitches of the embroidery pattern. In other words, the embroidery pattern that is being sewn is in a state in which the sewing operation has proceeded by the equivalent of a plurality of stitches in a state in which there was no upper thread. In this case, it is necessary to perform an operation (stitching back) that moves the needle drop point back to the position of the last stitch that the sewing operation made with the upper thread. In the case of a known sewing machine, the operation to move the needle drop point back is cumbersome, with a key operation for moving the needle drop point back being performed based on the user's visual observation of the embroidery pattern that is being sewn. However, in the present embodiment, the processing that will now be explained is performed by fourth control processing (Step S125; refer to FIG. 15). First, the user presses the pen tip 911 of the ultrasonic pen 91 against the work cloth 100 at the position to which the user wants to move back the needle drop point. The CPU 61 specifies the designated position based on the ultrasonic waves that are transmitted from the ultrasonic pen 91 and recognizes the designated position as the position (hereinafter referred as the restart position) where the sewing of the embroidery pattern will be restarted. The CPU 61 moves the work cloth 100 such that the needle drop point is positioned at the restart position, then restarts the sewing of the embroidery pattern. Processing for restarting the sewing of the embroidery pattern will now be explained in detail.

The fourth control processing will be explained with reference to FIG. 15. The CPU 61 displays on the LCD 15 a screen that notifies the user that an operating mode is in effect in which the position to which the needle drop point is to be moved back is designated using the ultrasonic pen 91 (Step S161). The CPU 61 determines whether the receivers 84, 85 have detected (received) the ultrasonic waves (Step S163). In a case where the receivers 84, 85 have not detected the ultrasonic waves (NO at Step S163), the processing returns to Step S163.

In a case where the user has pressed the pen tip 911 of the ultrasonic pen 91 against the work cloth 100 in order to designate the position to which the needle drop point is to be moved back, the CPU 61 detects the electrical signal that has been output from the ultrasonic pen 91 and specifies the time when the electrical signal was detected as the transmission time T1. The CPU 61 detects the electrical signals that the receivers 84, 85 have output and specifies the time when the electrical signals were detected as the detection time T2.

In a case where it is determined that the receivers 84, 85 have detected the ultrasonic waves (YES at Step S163), the CPU 61 specifies the designated position by computing the designated coordinates E based on the transmission time T1 and the detection time T2 (Step S165). The CPU 61 displays a screen on the LCD 15 that notifies the user that the designated position on the work cloth 100 has been specified as the restart position and at the same time, allows the user to check whether the restart position that was specified is valid or not (whether the restart position is right or wrong) (Step S167). The user performs a panel operation to input to the sewing machine 1 whether the restart position is valid or not.

The CPU 61 determines whether a panel operation that defines the restart position as valid is detected (Step S169). In a case where a panel operation that defines the restart position as invalid is detected (NO at Step S169), the processing for specifying the designated position will be performed again from the beginning, so the processing returns to Step S161.

On the other hand, in a case where the panel operation that defines the restart position as valid is detected (YES at Step S169), the CPU 61 sets, as the restart position, the designated position that was specified at Step S165 (Step S171).

The CPU 61 operates only the embroidery device 2 and moves the embroidery frame such that the position that is indicated by the X coordinate Xe and the Y coordinate Ye of the designated coordinates E that were specified at Step S165 becomes coincident with a needle drop point (Step S173).

The CPU 61 displays on the LCD 15 a screen that allows the user to check whether the restart position is valid or not. The user visually judges the restart position, then performs a panel operation to input to the sewing machine 1 whether the restart position is valid or not.

The CPU 61 determines whether the panel operation that defines the restart position as valid is detected (Step S175). In a case where a panel operation that defines the restart position as invalid is detected (NO at Step S175), the processing for specifying the designated position will be performed again from the beginning, so the processing returns to Step S161. On the other hand, in a case where the panel operation that defines the restart position as valid is detected (YES at Step S175), the CPU 61 operates the sewing machine motor 79 to restart the up-and-down movement of the needle bar 29 and controls the embroidery device 2 to restart the moving of the embroidery frame. That restarts the sewing from the restart position on the work cloth 100 that is held in the embroidery frame (Step S177). As described above, the fourth control processing is terminated, and the processing returns to the main processing (refer to FIG. 13). In the main processing, as shown in FIG. 13, after the fourth control processing (Step S125) is terminated, the processing returns to Step S121.

In this manner, simply by using the ultrasonic pen 91 to designate the desired position, the user is able to designate the position for restarting the sewing to the sewing machine 1. Therefore, in a case where the sewing machine 1 has suspended the sewing due to a break in the upper thread, the sewing can be restarted immediately from the position where the upper thread broke, simply by using the ultrasonic pen 91 to designate the position where the upper thread broke as the restart position. Accordingly, the embroidery pattern can be sewn on the work cloth 100 with good results.

Figure 13:
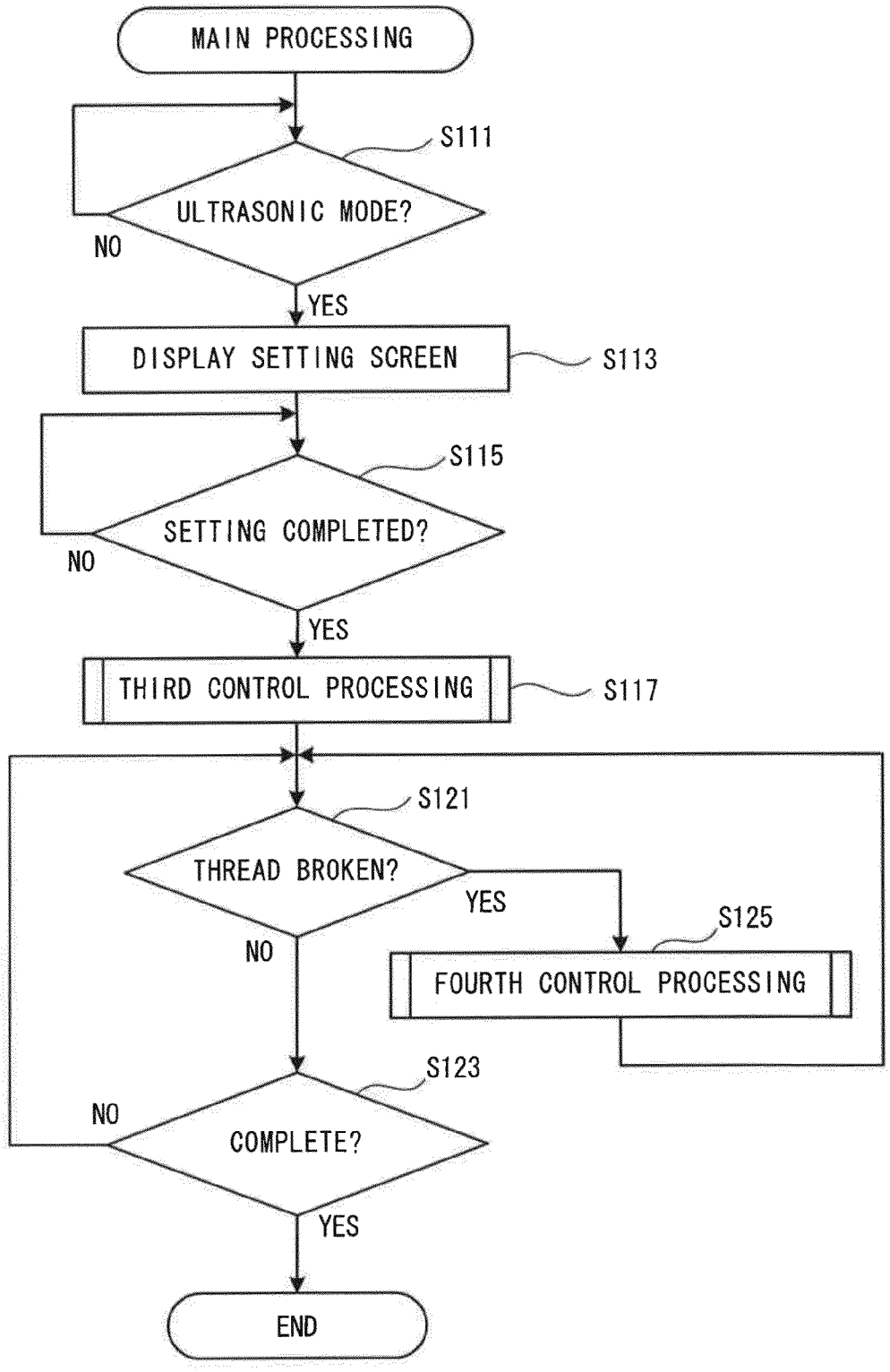
FIG. 13 is a flowchart that shows main processing according to the second embodiment.

On the other hand, in a case where the broken thread sensor 27 does not detect a break in the upper thread at Step S121 in FIG. 13, that is, in a case where the embroidery sewing has continued normally, without breaking the upper thread (NO at Step S121), the CPU 61 determines whether the sewing of the embroidery pattern has been completed (Step S123). In a case where the sewing of the embroidery pattern has not been completed (NO at Step S123), the processing returns to Step S121. In a case where the sewing of the embroidery pattern has been completed (YES at Step S123), the main processing is terminated.

As explained above, in the second embodiment, the user is able to make the sewing machine 1 to perform the sewing of the embroidery pattern at the desired position simply by using the ultrasonic pen 91 to designate the desired position on the work cloth 100. Furthermore, in a case where a break in the upper thread has occurred during the sewing of the embroidery pattern, the user is able to make the sewing machine 1 to restart the sewing from the position where the upper thread broke, simply by using the ultrasonic pen 91 to designate the position on the work cloth 100.

Note that the present disclosure is not limited to the embodiments that are described above, and various types of modifications can be made. In the embodiments that are described above, the designated position is specified based on the transmission time T1 and the detection time T2 for the ultrasonic waves. The method for specifying the designated position may also be a different method. For example, the designated position may be specified based only on the transmission time T1 for the ultrasonic waves. Note that more than two of the receivers may also be provided, although a detailed explanation of this will be omitted, and the sewing machine 1 may specify the designated position by specifying the detection time T2 when the ultrasonic waves are detected for each of the receivers.

In the second embodiment that is described above, the sewing machine 1 is provided with the broken thread sensor 27, and in a case where the broken thread sensor 27 has detected a break in the upper thread, the restart position is designated by the ultrasonic pen 91. However, it is also acceptable for the sewing machine 1 not to be provided with the broken thread sensor 27. In a case where a broken thread is confirmed visually by the user, the restart position may be designated in the same manner by the ultrasonic pen 91. Furthermore, in the second embodiment, the embroidery pattern is sewn by using the embroidery device 2, but the restart position may also be designated in the same manner when a break in the upper thread occurs during the sewing of an ordinary sewing pattern such as a straight line stitch, a zigzag stitch, a decorative stitch, or the like, instead of an embroidery pattern. The sewing machine 1 may also be provided with a lower thread sensor that detects when a break has occurred in a lower thread during the sewing and when the lower thread has been used up and has run out, and the restart position may also be designated in the same manner in a case where the lower thread sensor detects one of the break in the lower thread and the running out of the lower thread.

What is claimed is:

1. A sewing machine, comprising:

a sewing device including a needle bar configured to have a sewing needle, and a transport device configured to move a work cloth;

a plurality of detection devices configured to detect ultrasonic waves;

a processor; and a memory configured to store computer-readable instructions that instruct the sewing machine to execute steps comprising:

specifying, when an ultrasonic wave transmitted from a transmission source of the ultrasonic wave is detected by the detection devices, a position of the transmission source of the ultrasonic waves, based on the detected ultrasonic waves, specifying a sewing position on the work cloth based on the specified position of the transmission source, the sewing position including a restart position where sewing is to be restarted, moving the work cloth by the transport device in accordance with the specified sewing position so that the restart position is coincident with a needle drop point of the sewing needle, and restarting the sewing by the sewing device from the restart position.

2. The sewing machine according to claim 1, wherein specifying the position of the transmission source comprises specifying the position of the transmission source of the ultrasonic waves based on an elapsed time from when the detected ultrasonic waves are transmitted from the transmission source to when the detected ultrasonic waves are detected by the detection devices.

3. The sewing machine according to claim 1, wherein the sewing position includes a starting position where sewing is to be started, specifying the sewing position comprises specifying the position of the transmission source as the starting position, and the computer-readable instructions further instruct the sewing machine to execute steps comprising:

moving the work cloth by the transport device so that the specified starting position is coincident with the needle drop point of the sewing needle, and starting the sewing by the sewing device from the starting position after the specified starting position is made coincident with the needle drop point.

4. The sewing machine according to claim 1, wherein the sewing position includes an ending position where sewing is to be ended, specifying the sewing position comprises specifying the position of the transmission source as the ending position, and the computer-readable instructions further instruct the sewing machine to execute steps comprising:

moving the work cloth by the transport device so that, while the sewing is performed, the specified ending position is coincident with the needle drop point of the sewing needle, and ending the sewing by the sewing device at the ending position when the specified ending position is made coincident with the needle drop point.

5. The sewing machine according to claim 1, wherein the sewing position includes a pattern position where a pattern is to be sewn, specifying the sewing position comprises specifying the position where the pattern is to be sewn based on the pattern position, and the computer-readable instructions further instruct the sewing machine to execute steps comprising:

moving the work cloth in accordance with the specified position, and sewing the pattern in the position where the pattern is to be sewn.

6. The sewing machine according to claim 1, further comprising:

a thread detector configured to detect a break in a thread for the sewing, moving the restart position to be coincident with the needle drop point when the thread detector detects the break in the thread, and restarting the sewing from the restart position after the restart position is coincident with the needle drop point.

7. A non-transitory computer-readable medium storing computer-readable instructions that instruct a sewing machine that includes a sewing device including a needle bar configured to attach a sewing needle, and a transport device configured to move a work cloth, and a plurality of detection devices configured to detect ultrasonic waves to execute steps comprising:

specifying, when an ultrasonic wave transmitted from a transmission source of the ultrasonic wave is detected by the detection devices, a position of the transmission source of the ultrasonic waves, based on the detected ultrasonic waves, specifying a sewing position on the work cloth based on the specified position of the transmission source, the sewing position includes a restart position where sewing is to be restarted, moving the work cloth by the transport device in accordance with the specified sewing position so that the restart position is coincident with a needle drop point of the sewing needle, and restarting the sewing by the sewing device from the restart position.

8. The non-transitory computer-readable medium according to claim 7, wherein specifying the position of the transmission source comprises specifying the position of the transmission source of the ultrasonic waves based on an elapsed time from when the detected ultrasonic waves are transmitted from the transmission source to when the detected ultrasonic waves are detected by the detection devices.

9. The non-transitory computer-readable medium according to claim 7, wherein the sewing position includes a starting position where sewing is to be started, specifying the sewing position comprises specifying the position of the transmission source as the starting position, and the computer-readable instructions further instruct the sewing machine to execute steps comprising:

moving the work cloth by the transport device so that the specified starting position is coincident with the needle drop point of the sewing needle, and starting the sewing by the sewing device from the starting position after the specified starting position is made coincident with the needle drop point.

10. The non-transitory computer-readable medium according to claim 7, wherein the sewing position includes an ending position where sewing is to be ended, specifying the sewing position comprises specifying the position of the transmission source as the ending position, and the computer-readable instructions further instruct the sewing machine to execute steps comprising:

moving the work cloth by the transport device so that, while the sewing is performed, the specified ending position is coincident with the needle drop point of the sewing needle, and ending the sewing by the sewing device at the ending position when the specified ending position is made coincident with the needle drop point.

11. The non-transitory computer-readable medium according to claim 7, wherein the sewing position includes a pattern position where a pattern is to be sewn, specifying the sewing position comprises specifying a position where the pattern is to be sewn based on the pattern position, and the computer-readable instructions further instruct the sewing machine to execute steps comprising:

moving the work cloth by the transport device so that, while the sewing is performed, the specified ending position is coincident with the needle drop point of the sewing needle, and sewing the pattern in the position where the pattern is to be sewn.

12. The non-transitory computer-readable medium according to claim 7, further comprising:

moving the restart position to be coincident with the needle drop point when a broken thread detector detects the break in the thread, and restarting the sewing from the restart position after the restart position is coincident with the needle drop point.

* * * * *